United States Patent [19]

Skala

[11] 4,257,556

[45] Mar. 24, 1981

[54] FLUID HEAT TRANSFER SYSTEM

[76] Inventor: Stephen F. Skala, 3839 S. Wenonah Ave., Berwyn, Ill. 60402

[21] Appl. No.: 29,568

[22] Filed: Apr. 12, 1979

Related U.S. Application Data

[63] Continuation-in-part of Ser. No. 575,414, May 7, 1975, abandoned, which is a continuation-in-part of Ser. No. 756,392, Jan. 3, 1977, Pat. No. 4,164,253.

[51] Int. Cl.[3] ..... F24H 3/06

[52] U.S. Cl. ..... 237/7; 219/323; 219/325; 219/378; 165/39; 165/104 M; 237/8 A; 237/63

[58] Field of Search ..... 165/107, 104 M, 104 S, 165/39, 40; 237/1 SL, 7, 8 R, 8 B, 59, 63; 219/365, 378, 297, 325, 326, 323

[56] References Cited

U.S. PATENT DOCUMENTS

| | | | |
|---|---|---|---|
| 2,762,652 | 9/1956 | Carter | 165/107 X |
| 3,236,292 | 2/1966 | Smith, Jr. | 165/104 M X |
| 3,382,917 | 5/1968 | Rice | 165/104 S X |
| 4,164,253 | 8/1979 | Skala | 165/104 S X |

*Primary Examiner*—Albert W. Davis

[57] ABSTRACT

Only a limited number of organic or silicone liquid phase thermal exchange fluid types are suitable for operation over a wide range of hot and cold temperatures and these have an undesirable property of degrading at high temperatures. It is accordingly desirable to subject the thermal exchange fluid to high temperature only to the extent and times required by users. The present invention includes intermittent users which occasionally are required to attain maximum working temperatures at which thermal degradation of thermal exchange fluid occurs at a significant rate and a hot reservoir at the minimum working temperature. A stable heat transfer fluid transfers heat from the hot reservoir to the degradable thermal exchange fluid through a common intermediate heat exchanger. The degradable thermal exchange fluid is heated to a temperature just sufficient to satisfy the maximum current setpoint temperature of the intermittent users by controlling circulation of the stable heat transfer fluid. Lifetime of the degradable thermal exchange fluid is thereby extended without compromising effective heating of the intermittent users.

3 Claims, 2 Drawing Figures

FLUID HEAT TRANSFER SYSTEM

The present application is a continuation-in-part of application Ser. No. 575,414 filed May 7, 1975 now abandoned and of Ser. No. 756,302 filed Jan. 3, 1977 and now U.S. Pat. No. 4,164,253.

CROSS-REFERENCE TO RELATED APPLICATIONS

Ser. No. 792,455 now U.S. Pat. No. 4,156,454 entitled Oven with Refrigerated Food Storage Based on Thermal Exchange Fluid.

Ser. No. 908,509 now U.S. Pat. No. 4,188,794 entitled Freezer with Rapid Defrosting.

Ser. No. 941,123 entitled Pressure Cooking Appliance with Thermal Exchange Fluid.

Ser. No. 839,618 now U.S. Pat. No. 4,173,993 entitled Domestic Applicance System with Thermal Exchange Fluid.

BACKGROUND OF THE INVENTION

This invention relates to a system for transferring heat from a hot reservoir to a user by a thermal exchange fluid and having the particular freezer of extending lifetime of the thermal exchange fluid which is thermally degradable.

The invention has particular application to a system of domestic appliances wherein a single liquid phase thermal exchange fluid exchanges heat between the appliances and both a hot reservoir and a cold reservoir. The appliance system combines heating and cooling capability in simple appliance units and accumulates energy at off-peak hours and at low power levels for subsequent rapid release during peak use periods. These and other characteristics of the appliance system are described in more detail in the cited related applications and in the following patents. U.S. Pat. No. 3,888,303 describes a system of houseware units which are connectable to a source of thermal exchange fluid. U.S. Pat. No. 4,024,904 describes a range which exchanges heat between a pot or pan surface and a thermal exchange fluid in a heat exchanger by forced air convection.

Representative conditions to be satisfied by a thermal exchange fluid include a temperature range of −20° F. to 575° F. and a lifetime of more than 25 years without skilled preventive maintenance. The users operate intermittently with infrequent excursions to maximum working temperatures. Several commercial thermal exchange fluid types having generally satisfactory heat transfer characteristics over the cited temperature range have been designed for thermal stability, but even the most stable organic compounds change chemically at high temperatures over long periods. Undesirable effects which result from oxidation, cracking, and formation of higher polymers at high temperatures include vapor loss, viscosity increase and geling, and formation of flow and heat impeding deposits.

Thermal degradation over long periods is estimated conventionally from rates of undesirable effects occuring at higher temperatures over shorter periods. The scaling relation is an Arrehenius equation, $D=A\text{-}e^{-E/RT}$, where the constants A and activation energy E are determined from a range of degradation rates D at temperatures T. Once the constants are determined, degradation rates at lower temperatures are calculated. A representative accelerated test of a thermal exchange fluid is based on measurements over a period of several weeks of degradation products formed at temperatures ranging from about 600° F. to 700° F. At 650° F., the more stable thermal exchange fluids have a degradation rate of approximately 1% per week. Most thermal exchange fluids have an activation energy such that their degradation rate is doubled for every 18° F. increase in temperature. Accordingly, the following annual degradation rates are expected for lower temperatures: 600° F.—6.5%/yr; 550° F.—0.68%/yr. 500° F.—0.056%/yr; 450° F.—0.0036%/yr. At 450° F., the degradation over 25 years is less than 0.1% so that continuous long term operation at such lower temperatures would be satisfactory. For cooking appliances, however, the higher temperatures are occasionally required within the appliance and are useful for compensating for thermal impedances in the system to attain desired high temperatures rapidly. A preferred maximum temperature of the thermal exchange fluid would be between 600° F. and 550° F.

OBJECTS

It is a general object of this invention to provide an improved system for transferring heat by liquid phase fluids from a hot reservoir to intermittent users.

It is a further object to provide effective heating of the intermittent users during working periods at high temperatures and at other times to assure a satisfactory lifetime of a thermal exchange fluid which is thermally degradable.

SUMMARY

These and other objects and advantages which will become apparent are attained by this invention wherein two fluid circuits function to transfer heat from a hot reservoir by a stable heat transfer fluid through an intermediate heat exchanger to a thermally degradable thermal exchange fluid which transfers heat to one or more intermittent users. The hot reservoir is maintained at temperatures which are at least the maximum working temperature of the intermittent users and at which thermal degradation of the thermal exchange fluid would occur at a significant rate. The intermittent users have periods of substantial duration at temperatures at which the thermal degradation is not significant. Circulation of the heat transfer fluid between the hot reservoir and the intermediate heat exchanger is controlled to transfer heat to the degradable thermal exchange fluid to increase its temperature to a level just sufficient to satisfy current temperature requirements of the intermittent users. In a system having a plurality of intermittent users with each of the users controlled at its setpoint temperature by a servo valve which regulates flow of the thermal exchange fluid, a maximum setpoint detector selects the maximum current setpoint to control the circulation of the stable heat transfer fluid.

This system provides efficient heat storage in the hot reservoir, effective heating of the intermittent users, operation over a wide range of temperatures, and a satisfactory lifetime of the thermally degradable thermal exchange fluid.

DESCRIPTION OF THE DRAWINGS

FIG. 1 shows an elementary embodiment of the invention wherein heat is transferred from a hot reservoir to an intermediate heat exchanger by a stable heat transfer fluid and from the intermediate heat exchanger to an intermittent user by a thermally degradable thermal exchange fluid.

Figure 1:
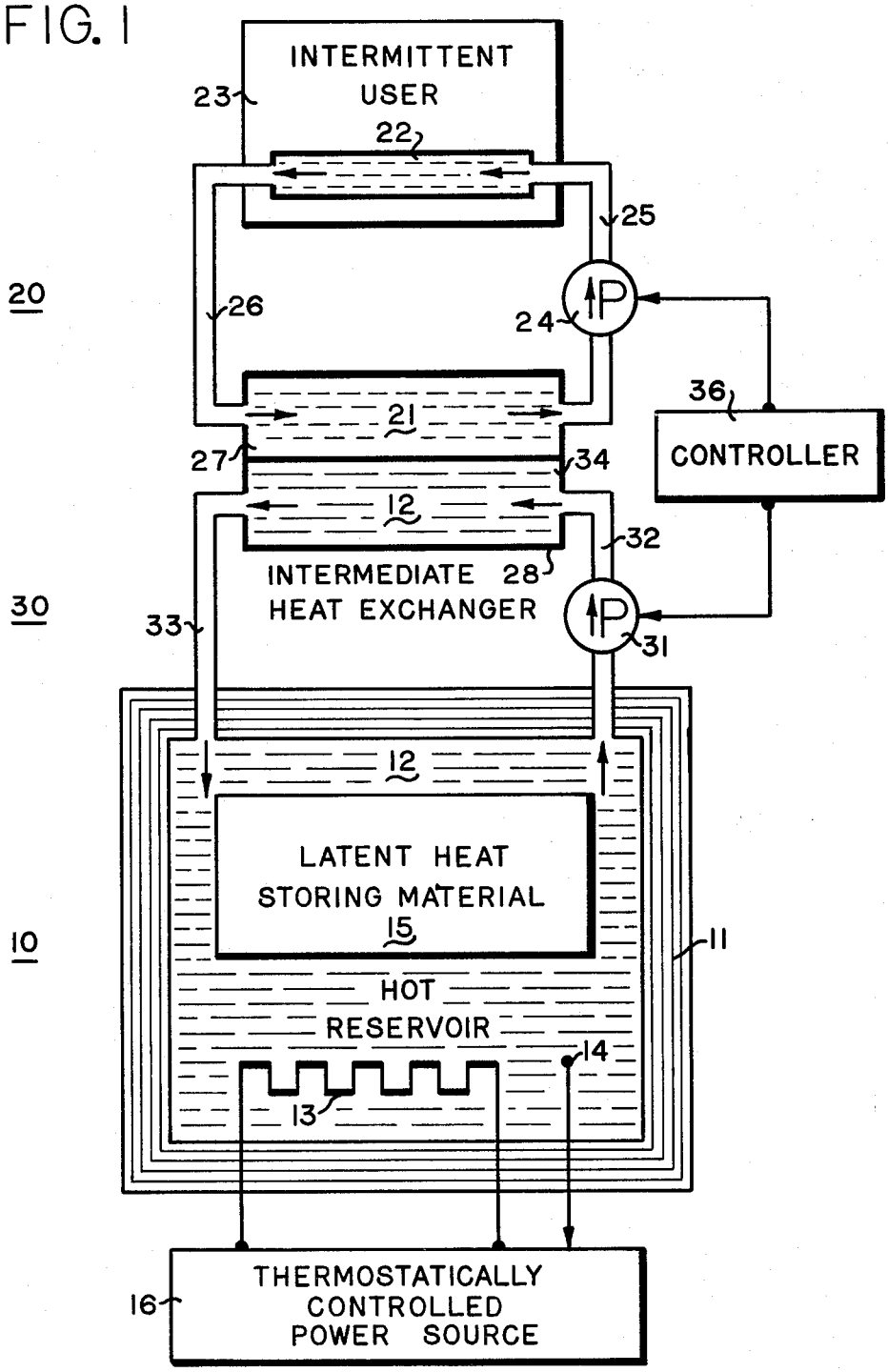
FIG. 1 is a diagrammatic drawing of an elementary embodiment of the system of the invention showing a hot reservoir, two fluid circuits having a common intermediate heat exchanger, an intermittent user, and means to control flow in the two fluid circuits according to the invention.

A hot reservoir assembly 10 comprises an insulated chamber 11, contained stable heat transfer fluid 12, an electrical heater 13, a temperature sensor 14, and an encapsulated latent heat storing material 15. A thermostatically controlled power source 16 receives temperature information from the temperature sensor 14 and receives electrical power from power lines, not shown. The thermostatically controlled power source 16 provides power at a moderate level to the heater 13 at off-peak hours when the temperature sensor is below a predetermined temperature above a phase transition temperature of the latent heat storing material to assure complete charging.

A first fluid conduit 20, in which a thermally degradable thermal exchange fluid 21 can circulate, comprises a heat exchanger 22 in an intermittent user 23, a motor operated pump 24 in supply conduit 25, a return conduit 26, and a first portion 27 of an intermediate heat exchanger 28. A second fluid circuit 30, in which the stable heat transfer fluid 12 can circulate, comprises the hot reservoir 10, an electromagnetic pump 31 in supply conduit 32, a return conduit 33, and a second portion 34 of the intermediate heat exchanger 28.

A controller 40 provides power to operate pump 24 and pump 31 either when the controller is initiated manually or in response to a predetermined program. The pumps circulate the thermal exchange fluid in the first fluid circuit and the heat exchange fluid in the second fluid circuit. Except for a small temperature difference due to thermal impedence, temperature of the heat transfer fluid 12 flowing through the intermediate heat exchanger is substantially at the temperature of the hot reservoir. Similarly, temperature of the thermal exchange fluid also flowing through the intermediate heat exchanger is substantially at the temperature of the heat transfer fluid. Temperature of the intermittent user then approaches its maximum working temperature which is substantially the temperature of the hot reservoir and at which temperature thermal degradation of the thermal exchange fluid occurs at a significant rate. When the controller 40 does not provide power for the pumps to attain idle temperature in the intermittent user, circulation of the fluids in the first and second fluid circuits stops, heat is not transferred from the hot reservoir, and temperature of the thermal exchange fluid decreases to ambient levels at which thermal degradation is not significant.

The preferred heat transfer fluid in the second fluid circuit is NaK which is an alloy of sodium and potassium. NaK is thermally stable, remains in a liquid phase at temperatures to which it is exposed in the present system, and provides conductive heat transfer within the hot reservoir. When the heat transfer fluid is a liquid metal, pump 31 is preferably of the electromagnetic type and can be part of a sealed system to preclude oxidation or loss of the liquid metal.

The preferred thermal exchange fluid in the first fluid circuit is the aromatic hydrocarbon "Therminol 60" manufactured by Monsanto Corporation which has the following properties: an operating temperature range of −60° F. to 600° F., a specific heat of approximately 0.5, and a vapor pressure at 600° F. of 760 mm Hg. It has an auto-ignition temperature of 835° F. and is classified as practically non-toxic based on vapor inhalation and oral and skin absorption studies.

Examples of latent heat storing materials having large specific heats of phase transition at suitable temperatures include sodium hydroxide with a heat of fusion of 40 cal/gm at 604° F. and sodium nitrate with a heat of fusion of 45 cal/gm at 631° F. The phase transition temperature of either salt can be lowered by partial substitution of potassium for sodium.

Additional details of a hot reservoir assembly may be found in the cited parent applications.

Figure 2:
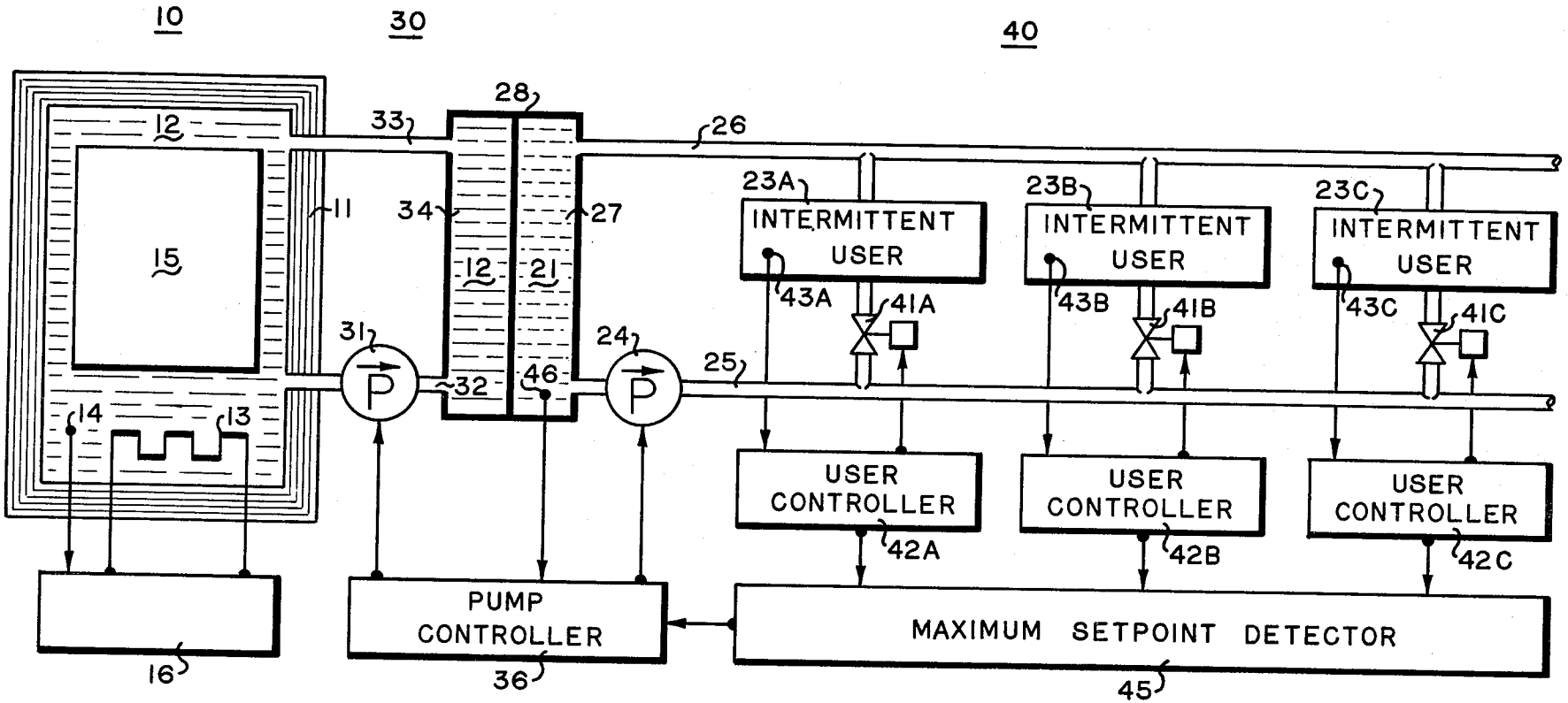
FIG. 2 is a diagrammatic drawing of the preferred embodiment showing additionally to FIG. 1 a plurality of intermittent users and means for controlling temperature of the degradable thermal exchange fluid in accordance with the invention.

In FIG. 2, heat is transferred from a hot reservoir to a thermally degradable thermal exchange fluid by a stable heat transfer fluid as described with reference to FIG. 1 and has the added feature of limiting temperature of the thermal exchange fluid to substantially the maximum current working temperature requirement of a plurality of intermittent users.

Hot reservoir assembly 10 comprises an insulated chamber 11, contained heat transfer fluid 12, heater 13, temperature sensor 14, latent heat storing material 15, and thermostatically controlled power source 16 which are described with reference to FIG. 1. A second fluid circuit 30, also described with reference to FIG. 1, comprises a second portion 34 of intermediate heat exchanger 28, the hot reservoir assembly 10, conduit 32 and conduit 33 connecting the hot reservoir to the intermediate heat exchanger, and means such as pump 31 to circulate a stable heat transfer fluid 12 in the second fluid circuit.

The second fluid circuit 30 is in a heat exchange relationship with a first fluid circuit 40 containing a thermally degradable thermal exchange fluid 21 which can be circulated to transfer heat from the intermediate heat exchanger 28 to a plurality of intermittent users such as 23A, 23B, and 23C. The first fluid circuit comprises the first portion 27 of the intermediate heat exchanger, a supply conduit 25, a motor operated pump 24, heat exchangers not shown in the intermittent users, and a return conduit 26. The pump 24 develops a differential pressure between thermal exchange fluid in the supply conduit 25 and the return conduit 26 so that the thermal exchange fluid flows through the intermittent users unless impeded by flow regulating means such as solenoid operated regulator valves 41A, 41B, and 41C.

The first and the second fluid circuits operate to transfer heat from the hot reservoir assembly 10 to the intermittent users in response to user temperature setpoint information. Each of a plurality of user controllers 42A of which information the maximum setpoint is selected to control temperature in the first fluid circuit, 42B and 42C is set manually or by a program to provide temperature setpoints as a function of time. The user controllers transmit current setpoint information to maximum setpoint detector 45 which transmits the maximum of the user temperature setpoints to pump controller 36 which transmits full power to pump 31 until the temperature at sensor 46 is substantially at the maximum setpoint temperature. The pump controller than regulates power to pump 31 at a lower level to maintain the temperature of the thermal exchange fluid at the sensor 46 at the maximum setpoint temperature. The thermal exchange fluid is at a temperature sufficient to meet demands of all of the intermittent users yet is not exposed to temperatures at which thermal degradation would occur at a significant rate when the maximum working temperatures near the temperature of the hot reservoir are not required. When all of the user controller temperature setpoints are at idle temperature, pump 31 does not operate and temperature of the intermediate heat exchanger cools to ambient levels. Each of the user controllers regulates flow of the thermal exchange fluid through the intermittent user to maintain its temperature at its setpoint. When any setpoint is above ambient temperature, the pump controller provides power to pump 24 to maintain the differential pressure between the supply conduit 25 and the return conduit 26 at a predetermined pressure in response to such means as a pressure transducer not shown. Each of the user controllers is connected to one of a plurality of temperature sensors 43A, 43B, and 43C. When a temperature sensor such as 43A is at a temperature lower than the setpoint of user controller 42A, the user controller transmits power to the solenoid of regulator valve 41A which allows increased flow of hot thermal exchange fluid through the intermittent user until its temperature reaches the setpoint temperature.

Assemblies for regulating flow of the thermal exchange fluid and for processing temperature and setpoint information are based on known control and servo components. In the user controllers, the setpoints are voltages which are established by such means as a potentiometer circuit and which are compared to voltages from the sensors 43A, 43B, and 43C in comparator circuits. Sensors for temperature having voltage outputs corresponding to the temperature include thermocouples and thermistors. An output of the comparator circuits controls power to the solenoids of the regulator valves as described previously. In the maximum setpoint detector, the received setpoint voltages are sampled serially by an input to a hold circuit. The hold circuit comprises a capacitor which is charged through a diode to the highest of the sampled setpoint voltages. The charge on the capacitor will not discharge through the diode but a small bleeding current slowly reduces the maximum setpoint voltage unless it is restored by the sampling process thereby following the present maximum setpoint. The pump controller 36 includes a comparator circuit, not shown, which compares the output voltage of sensor 46 to the maximum user setpoint voltage from the maximum setpoint detector 45 to develop a voltage output when the temperature at the sensor 46 is less than the present maximum of the user temperature setpoints. The voltage ouput of the comparator circuit then turns on an amplifier in the pump controller to operate the pump 31 at full power.

In the temperature control process, a small predetermined allowance may be made for temperature drops due to thermal impedences of the heat exchangers so that intermittent user temperature can be maintained at its setpoint. Further, the user controller may include programs for transient heating of the thermal exchange fluid substantially above setpoint levels when a rapid temperature rise of the intermittent user to the setpoint would be appropriate. Such temperature programs are in accordance with the invention and provide effective heating when required while avoiding thermal degradation of the thermal exchange fluid at significant rates at other times.

What I claim is:

1. A fluid heat transfer system comprising a plurality of intermittent users having maximum working temperatures which degrade a degradable thermal exchange fluid at a significant rate and having periods of substantial duration when all said users are at temperatures which do not degrade the thermal exchange fluid at a significant rate, a first fluid circuit in which the thermal exchange fluid can circulate comprising a first portion of an intermediate heat exchanger, a supply conduit and a return conduit connecting to the first portion of the intermediate heat exchanger, means to develop a differential pressure between the supply conduit and the return conduit, the intermittent users each connecting between the supply conduit and the return conduit, and means to regulate flow of the thermal exchange fluid through each of the intermittent users to control current working temperature, a second fluid circuit comprising a second portion of the intermediate heat exchanger, a hot reservoir maintained at a temperature which is at least the highest of the maximum working temperatures, conduits connecting the second portion of the intermediate heat exchanger to the hot reservoir, and means to circulate a stable heat transfer fluid in the second fluid circuit thereby transferring heat from the hot reservoir through the intermediate heat exchanger to the degradable thermal exchange fluid, means to detect a current maximum setpoint temperature of the intermittent users, means to sense temperature of the thermal exchange fluid in the intermediate heat exchanger, and means to control the circulation of the stable heat transfer fluid to maintain said sensed temperature of the degradable thermal exchange fluid in the intermediate heat exchanger at the current maximum setpoint thereby extending lifetime of the degradable thermal exchange fluid without compromising effective heating capability of the intermittent users.

2. The system of claim 1 wherein the hot reservoir includes a latent heat storing material having a phase transition temperature at said temperature which is at least the maximum working temperature of the intermittent users.

3. The system of claim 1 wherein the stable heat transfer fluid is a liquid metal and the means to circulate the liquid metal heat transfer fluid is an electromagnetic pump.

* * * * *